US005123555A

United States Patent [19]

Luch et al.

[11] Patent Number: 5,123,555

[45] Date of Patent: Jun. 23, 1992

[54] CONTAINER CAP HAVING EXTERNAL BEAD

[75] Inventors: Daniel Luch, Los Gatos; Brian M. Adams, Newark, both of Calif.

[73] Assignee: Cap Snap Co., San Jose, Calif.

[21] Appl. No.: 694,450

[22] Filed: May 1, 1991

[51] Int. Cl.[5] ..... B65D 41/48

[52] U.S. Cl. ..... 215/256; 215/250; 220/258

[58] Field of Search ..... 215/247, 249, 250, 254, 215/256, 317, 321; 220/256, 257, 258, 265

[56] References Cited

U.S. PATENT DOCUMENTS

| | | | |
|---|---|---|---|
| 3,247,993 | 4/1966 | Gelbjerg-Hansen et al. | 215/321 |
| 3,392,860 | 7/1968 | Faulstich . | |
| 3,392,862 | 7/1968 | Faulstich . | |
| 3,825,144 | 7/1974 | Wiedmer | 215/321 X |
| 3,840.137 | 8/1974 | Faulstich | 215/256 |
| 3,979,002 | 9/1976 | Faulstich | 215/256 |
| 4,421,146 | 12/1983 | Bond | 141/349 |
| 4,577,771 | 3/1986 | Martinez | 215/256 |
| 4,699,188 | 10/1987 | Baker et al. | 141/18 |
| 4,901,881 | 2/1990 | McElroy | 220/287 |
| 4,911,316 | 3/1990 | Tackles | 215/256 |

*Primary Examiner*—Stephen Marcus
*Assistant Examiner*—Nova Stucker
*Attorney, Agent, or Firm*—Julian Caplan

[57] ABSTRACT

A plastic cap is used on containers, particularly of the type used commercially for five-gallon bottles containing liquids such as drinking water. A bead is formed on the exterior, preferably above the elevation of the horizontal tear line conventionally used in such caps. The bead is preferably flat on the outside surface and wide in a vertical sense. The bead functions to cause the cap to engage the neck of the container more securely. It also functions to retain in place a dust cap which fits over the top of the cap. It further functions as a seal for the type of cap used in certain water dispensers. Such dispensers are used without removing the cap from the container in that the top disk is opened after the container has been installed in the dispenser. The bead seals against the inside of a sleeve incorporated in such a dispenser.

11 Claims, 1 Drawing Sheet

CONTAINER CAP HAVING EXTERNAL BEAD

BACKGROUND OF THE INVENTION

1. Field of the Invention

This invention relates to a new and improved container cap having an external bead. More particularly, the invention relates to such a cap used to close a neck of a bottle such as that type installed in water dispensers. The cap has an external bead having at least three advantages. One is that it provides a means to hold a dust cap or plastic shrink wrap fitting over the top of the closure. Another is that the bead seals against a flange of a dispenser when the bottle with cap intact is installed in such dispenser. Third is that it assists a water bottle delivery truck driver in gripping the bottle and prevents it from slipping from his grasp.

2. Description of Related Art

Caps which seal on five-gallon water bottles and the like have been used for many years. Representative caps are shown in the following U.S. patents owned by assignee: U.S. Pat. Nos. 3,392,860; 3,392,862; 3,840,137; 4,911,316. The present invention differs from such prior art caps, among other reasons, in that it has a flange on the exterior of the skirt which may be engaged by a dust cover which fits over the top of the cap and prevents contamination of the cap during transportation and storage.

Dispensers for water traditionally have required that the closure be removed from the bottle before it is installed in a dispenser. However, recently there have been proposals to construct dispensers in such manner that the cap is not removed prior to installation. On the contrary, either the cap is punctured or a valve in the cap is opened, permitting the water to be discharged with the cap still on the neck of the bottle. Accordingly another advantage of the external bead of the present invention is that it is so constructed that it may form a watertight seal against a flange or other portion of the dispenser to seal the cap (and thereby the container) from unintentional leakage. Cap constructions of the type mentioned in this paragraph of this specification include U.S. Pat. Nos. 4,421,146 and 4,699,188, upon which the present invention is an improvement.

SUMMARY OF THE INVENTION

A resilient plastic container cap fits over the neck of a plastic or glass container such as a five-gallon water bottle. Such a container may have an external bead below the lip at the opening of the neck and a concavity below the bead. The cap of the present invention seals against the lip and the external bead and also grips the cavity. Desirably such caps are tamper-evident in that they cannot be removed once installed without tearing off the bottom of the skirt. The present invention employs a horizontal score line merging with a downwardly extending second score line which extends to the bottom edge of the cap. By pulling a tab adjacent the second score line, the lower portion of the cap may be torn by pulling upward along the second score line and then horizontally around the first mentioned score line, removing a sufficient portion of the cap so that the remaining portion may be removed and, when desired, re-installed. It will be understood, however, that the present invention may be used with a cap which is not removed before being placed in a dispenser, in which case the means for tearing off the bottom of the skirt may be eliminated.

In one type of dispenser such as that shown in U.S. Pat. No. 4,699,188 it is desirable to form a central well in the top disk of the cap into which the end of a dispenser tube may enter and open the bottom of the well. During this operation (when the container is inverted) the skirt of the cap is received inside a sleeve. The cap of the present invention has an external bead on its skirt which seals against the aforesaid sleeve preventing the contents of the container from leaking.

Water containers of this type are usually delivered in trucks and are thereby exposed to dust and other contaminants. To prevent such contaminants from contact with the dispenser or, indeed, with the top of the cap, the present invention provides a dust cover or plastic wrap which engages the aforesaid external bead so that the protective cover is held in place thereby. The use of such a cover is especially useful when the cap has a central well formed in the top disk. Such a well tends to accumulate dust unless a cover of the present invention is applied.

Drivers of bottled water delivery trucks frequently grip the cap to lift the bottle. The bead on the exterior of the cap improves the driver's grip on the cap.

DESCRIPTION OF DRAWINGS

The accompanying drawings, which are incorporated in and form a part of this specification, illustrate embodiments of the invention and, together with the description, serve to explain the principles of the invention.

DESCRIPTION OF PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
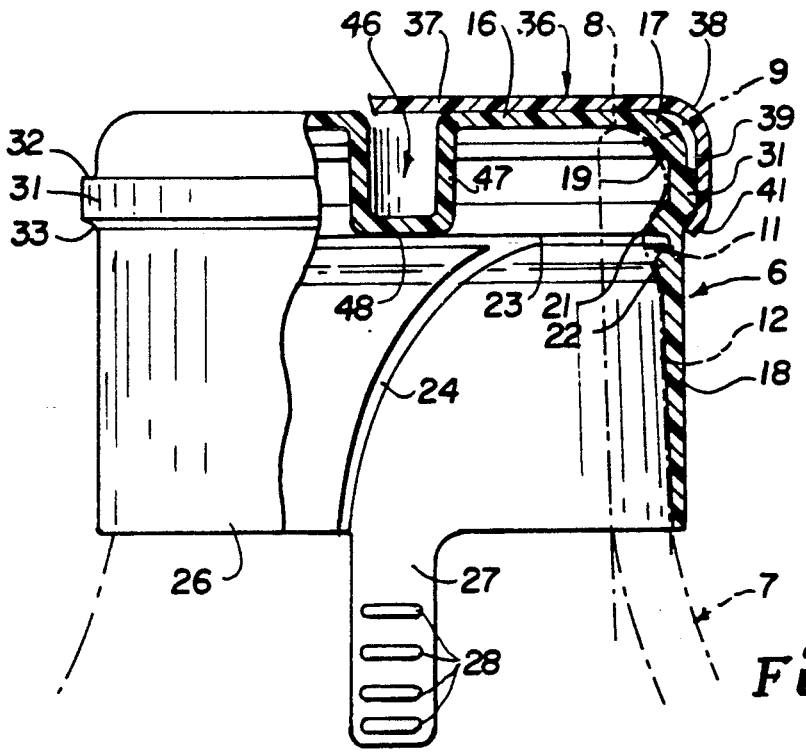
FIG. 1 is a side elevational view showing a cap and a portion of a dust cover in accordance with the present invention applied on a container neck, the structure being partially broken away in section to reveal internal construction.

Cap 6 is installed on a container neck 7. The neck 7 is subject to considerable variation but as here shown has a rounded lip 8 at its upper end and an external top convex bead 9 outwardly of lip 8. Below bead 9 is a concave depression 11. The exterior of the neck 7 below surface 11 is subject to considerable variation and accordingly the container is shown in FIG. 1 schematically.

Cap 6 has a top disk 16 (which, as will be hereinafter explained, is actually annular) and externally of the disk 16 there is a rounded corner from which depends skirt 18. The interior of cap 16 has an upper internal sealing bead on the inside of the rounded corner 17 which seals against the upper area of bead 9. Intermediate internal sealing bead 21 seals against the underside of bead 9 and the depression 11. Preferably the beads 19 and 21 are sufficiently flexible so that they form a watertight seal so long as cap 16 is seated on the neck 7 and is intact. A lower internal stiffening bead 22 is located opposite the depression 11 and is so dimensioned that it permits the cap 6 to be installed on the neck 7 without splitting or damaging the neck 7 but provides sufficient tension on the upper end of the cap so that the beads 19 and 21 perform their sealing function.

In accordance with conventional tamper-evident cap construction, there is a horizontal score line 23 located below bead 21 and above bead 22. Additionally there is a downward curving second score line 24 which extends to the bottom edge 26 of skirt 18. Adjacent the score line 24 is a depending tear tab 27 preferably having gripper ribs 28 on one or both of its surfaces. The consumer may grip the tab 27, pull upward causing the skirt to tear along score line 24 and then around the entire circumference of score line 23 or a portion thereof. However, it will be understood, that the present invention has particular utility in caps which need not be removed before being installed in the dispenser and hence the tab 27 and score lines 23 and 24 may, if desired, be eliminated.

An important feature of the present invention is the provision of an external bead 31 located on the upper end of the skirt 18, preferably above the score line 23. Bead 31 has a top edge 32 here shown below the disk 16, and a bottom shoulder 33 which may be somewhat downwardly-inwardly slanted.

Dust cover 36 may be installed on cap 16 during transportation and storage. Cover 36 has a top disk 37 slightly larger than disk 16, a rounded corner 38 which fits over the corner 17, and a short depending skirt 39 which fits over the outside of bead 31. The lower edge of skirt 39 has an inward directed flange 41 which engages under the bead 31 and locks against the shoulder 33. The cover 36 is sufficiently thin and flexible so that it may easily be removed when desired.

Figure 2:
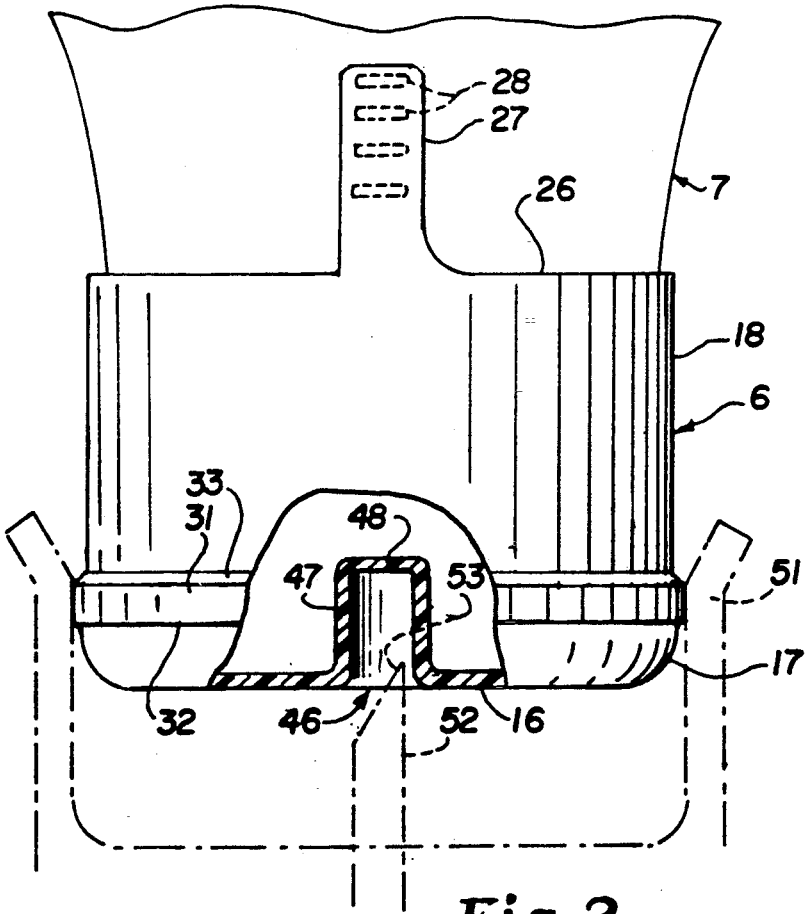
FIG. 2 shows the structure of FIG. 1 (with dust cover removed) inverted and about to be installed in a dispenser.

The caps shown in FIGS. 1 and 2 are illustrated with the idea in mind that the container may be used in a water dispenser without removal of the cap. For such purposes cap 6 is shown with a well 46 located centrally of top disk 16. The well 46 has a cylindrical sidewall 47 and a base or bottom 48, the well being watertight when intact. It will be seen that one of the principal advantages of the dust cover 36 is that it encloses the well 46 and prevents dust or other contaminants from lodging in the well during transportation or storage.

Directing attention now to FIG. 2, there is shown schematically portions of a water dispenser, namely a cylindrical sleeve 51 within which is an upward extending feed tube 52 having a pointed end 53. When the container 7 is pushed down within the sleeve 51, the tube 52 enters the well 46 and punctures the base 48 allowing liquid to flow out through the hollow tube 52. Other complementary feed tube/opening systems maybe substituted for the simple piercing mechanism depicted in FIG. 2. The structure of FIG. 2 shows another important advantage of the external bead 31 in that it seals against the inside of the sleeve 51 and prevents water from leaking out. It will be understood that the bead 31 has utility in other types of dispensers in that it forms a convenient sealing means to seal the cap, and thereby the container, from leakage when the container is installed in a dispenser.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container cap for use with a container neck of the type having a top lip, a convex container bead immediately below the top lip, and a concave depression below the container head, said cap being of the type having a top dimensioned to fit over the top lip, a convex rounded corner below said top shaped and dimensioned to fit around the container bead, a skirt below said rounded corner and engagement means on the interior of said skirt positioned and dimensioned to fit into the concave depression and engage the underside of the container bead to secure and seal said cap on the neck, the improvement which comprises an external cap bead on the exterior of said skirt positioned below said rounded corner and above the level of said engagement means and extending up to said rounded corner, said external cap bead having a diameter greater than that of any other portion of said cap and characterized by the fact that said external cap bead is approximately at the level of said convex container bead in the assembled condition of said cap on said container neck.

2. A cap according to claim 1 in which said external bead has a vertically elongated sealing surface adapted to seal against a flange into which said cap and neck are inserted.

3. A cap according to claim 1 in which said external bead has a lower edge formed as a shoulder, said shoulder being adapted to be engaged by a dust cover having a second skirt dimensioned to fit over said first-mentioned skirt.

4. In combination, a container cap for use with a container neck of the type having a top lip, a convex container bead immediately below the top lip, and a concave depression below the container bead, said cap being of the type having a top dimensioned to fit over the top lip, a convex rounded corner below said top shaped and dimensioned to fit around the container bead, a skirt below said rounded corner and engagement means on the interior of said skirt positioned and dimensioned to fit into the concave depression and engage the underside of the container bead to secure and seal said cap on the neck, the improvement which comprises an external cap bead on the exterior of said skirt positioned below said rounded corner, said external cap bead having a diameter greater than that of any other portion of said cap, and a cover for the upper end of said cap, said cover having a top cover fitting over said cap top, a cover skirt extending downward from said top cover around the outside of said cap skirt and engaging said external bead to detachably hold said cover on said cap, said external bead having a lower edge formed with a shoulder and said cover skirt having an internal flange positioned and dimensioned to engage under said shoulder to hold said cover in place.

5. A container cap for use with a container neck of the type having a top lip, a convex container bead immediately below the top lip, and a concave depression below the container bead, said cap being of the type having a top dimensioned to fit over the top lip, a convex rounded corner below said top shaped and dimensioned to fit around the container bead, a skirt below said rounded corner and engagement means on the interior of said skirt positioned and dimensioned to fit into the concave depression and engage the underside of the container bead to secure and seal said cap on the neck, the improvement which comprises an external cap bead on the exterior of said skirt positioned below said rounded corner, said external cap bead having a diameter greater than that of any other portion of said cap, said external bead having a vertically elongated sealing surface adapted to seal against a flange into which said cap and neck are inserted, said cap being formed with a well in said top, said well having a cylindrical wall and a means for closing off the bottom of said well.

6. In combination, a cap according to claim 5 and a sleeve for a water dispenser shaped to receive said neck with said cap thereon, said external bead being positioned and dimensioned to seal against said sleeve, said rounded corner being dimensioned less than the internal diameter of said sleeve.

7. The combination of claim 6 which further comprises a tube for a water dispenser positioned centrally with respect to said sleeve dimensioned to fit into said well and open the bottom portion of said well for dispensing liquid through said tube.

8. A container cap for use with a container neck of the type having a top lip, a convex container bead immediately below the top lip, a concave depression below the container bead, immediately below the top lip, and a concave depression below the container bead, said cap being of the type having a top dimensioned to fit over the top lip, a convex rounded corner below said top shaped and dimensioned to fit around the container bead, a skirt below said rounded corner and engagement means on the interior of said skirt positioned and dimensioned to fit into the concave depression and engage the underside of the container bead to secure and seal said cap on the neck, the improvement which comprises an external cap bead on the exterior of said skirt positioned below said rounded corner, said external cap bead having a diameter greater than that of any other portion of said cap, said cap being tamper evident and formed with a horizontal first score line extending at least partially around said cap, a second score line extending from said first score line down to the bottom edge of said skirt and a tear tab extending below said bottom edge to one side of said second score line, whereby the user may grip said tear tab, pull upward to tear said skirt along said second score line and then at least partially around said first score line to facilitate removal of said cap from said neck.

9. In combination, a container neck, said neck comprising a top lip, a convex container bead immediately below said top lip, and first engagement means on the exterior of said neck below said convex container bead, and a cap, said cap comprising a top dimensioned to fit over said top lip, a convex rounded corner below said top shaped and dimensioned to fit around said container bead, a skirt below said rounded corner and second engagement means on the interior of said skirt cooperable with said first engagement means to secure said cap on said neck, and an external cap bead on the exterior of said skirt positioned below said rounded corner and above the level of said second engagement means and extending up to said rounded corner, said external cap bead having a diameter greater than that of any other portion of said cap, said external cap bead being approximately at the level of said convex container bead.

10. In combination, a container neck, said neck comprising a top lip, a convex container bead immediately below said top lip, and first engagement means on the exterior of said neck below said convex container bead, and a cap, said cap comprising a top dimensioned to fit over said top lip, a convex rounded corner below said top shaped and dimensioned to fit around said container bead, a skirt below said rounded corner and second engagement means on the interior of said skirt cooperable with said first engagement means to secure said cap on said neck, an external cap bead on the exterior of said skirt positioned below said rounded corner, said external cap bead having a diameter greater than that of any other portion of said cap, which further comprises a water dispenser having a flange and in which said external cap bead is dimensioned to seal against said flange when said cap and neck are inserted into said flange.

11. In combination, a container neck, said neck comprising a top lip, a convex container bead immediately below said top lip, and first engagement means on the exterior of said neck below said convex container bead, and a cap, said cap comprising a top dimensioned to fit over said top lip, a convex rounded corner below said top shaped and dimensioned to fit around said container bead, a skirt below said rounded corner and second engagement means on the interior of said skirt cooperable with said first engagement means to secure said cap on said neck, an external cap bead on the exterior of said skirt positioned below said rounded corner, said external cap bead having a diameter greater than that of any other portion of said cap, said external bead having a lower edge formed as a shoulder, and a dust cover for the upper end of said cap, said cover having a top cover fitting over said cap top, a cover skirt fitting over said external bead, and a cover internal flange on the inside of said cover skirt positioned and dimensioned to engage under said shoulder to hold said cover on said cap.

* * * * *